US006890407B1

(12) United States Patent
Koivukunnas et al.

(10) Patent No.: US 6,890,407 B1
(45) Date of Patent: May 10, 2005

(54) METHOD AND APPARATUS FOR PRODUCING CALENDERED PAPER OR BOARD

(75) Inventors: Pekka Koivukunnas, Järvenpää (FI); Matti Lares, Tuusula (FI); Mika Leino, Simpele (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/009,878

(22) PCT Filed: May 15, 2000

(86) PCT No.: PCT/FI00/00438

§ 371 (c)(1),
(2), (4) Date: Nov. 13, 2001

(87) PCT Pub. No.: WO00/70146

PCT Pub. Date: Nov. 23, 2000

(30) Foreign Application Priority Data

May 14, 1999 (FI) ..... 991108

(51) Int. Cl.[7] ..... D21F 11/00

(52) U.S. Cl. ..... 162/205; 162/204; 162/214; 162/361; 162/358.1; 162/358.3; 100/38; 100/306; 100/311; 100/313; 100/153; 100/161

(58) Field of Search ..... 162/198, 263, 162/136, 205, 206, 207, 265, 281, 361, 375, 358.1, 214; 100/38, 306, 311, 313, 153, 161

(56) References Cited

U.S. PATENT DOCUMENTS

| | | | | | |
|---|---|---|---|---|---|
| 5,651,863 | A | * | 7/1997 | Van Haag et al. | 162/207 |
| 5,658,432 | A | | 8/1997 | Heaven et al. | 162/198 |
| 6,179,964 | B1 | | 1/2001 | Begemann et al. | 162/198 |
| 6,413,371 | B1 | * | 7/2002 | Ahonen et al. | 162/136 |
| 6,418,840 | B1 | * | 7/2002 | Viljanmaa | 100/38 |

FOREIGN PATENT DOCUMENTS

| | | | |
|---|---|---|---|
| EP | 0 826 821 A2 | 3/1998 | D21G/9/00 |
| WO | WO 95/34715 | 12/1995 | D21G/1/00 |
| WO | WO 98/32916 | 7/1998 | D21F/1/02 |
| WO | WO 98/44195 | 10/1998 | D21G/1/00 |

* cited by examiner

*Primary Examiner*—Peter Chin
*Assistant Examiner*—Mark Halpern
(74) *Attorney, Agent, or Firm*—Cohen, Pontani, Lieberman & Pavane

(57) ABSTRACT

A method and an arrangement for manufacturing calendered paper or board particularly in the on-line manufacturing method. In the method, a base web is formed from a mixture of water and pulp supplied from the headbox and the web is dried by removing water over the press section and over the dryer section by heating. The formed web is calendered at least once to modify the surface on at least one of its sides. Before calendering the cross-direction thickness profile of the web is standardized and calendering is carried out by means of a long-nip calender, whereby good surface quality is obtained without losing the bulk or stiffness of the web.

41 Claims, No Drawings

METHOD AND APPARATUS FOR PRODUCING CALENDERED PAPER OR BOARD

FIELD OF THE INVENTION

The present invention relates to a method for producing paper or board in a system where the manufactured base web is treated by means of at least one calendar for improving its surface properties.

More specifically, a preferred embodiment of the invention relates to on-line calendering in which at least one calendering step is carried out immediately after the manufacture of the base web without any intermediate reeling.

The invention also relates to an arrangement for implementing the method.

BACKGROUND OF THE INVENTION

The invention particularly concerns the manufacture of paper or board by using on-line calendering. In on-line calendering, the calender is arranged immediately after the paper or board machine or a coating line and the web is taken directly to the calender without any intermediate reeling. Conventionally, machine calenders where the web travels between two hard rolls have been used as on-line calenders. Today, softcalenders are becoming more and more common because of the better surface gloss they achieve. Striving for improved surface gloss and smoothness has further prompted the development of multi-nip calenders suited for on-line calendering. The maximum production speed of the supercalenders used previously has been insufficient, preventing their use in connection with fast production lines.

The purpose of calendering is to increase smoothness and gloss and to improve other properties of the printing surface of paper or board. The improved properties upgrade the quality of the final printed surface. The quality and printability of the printed surface a re among the most important quality factors appreciated by paper users. Similarly, the printability of printing board and the quality of the printed surface thereof are important and, in addition, high stiffness and good bulk are often appreciated. Furthermore, a factor affecting product quality is the evenness of the c ross direction profile of the web, i.e., any variations in web thickness should be as small as possible in the cross-machine direction.

Surface smoothness of the product is achieved by exposing the fibre structure of the product to high pressure and temperature by heating the hard calender rolls and by pressing the rolls against one another such that a high nip pressure is obtained in the nip between the rolls. Due to these forces the fibres forming the web reach their glass transition temperature, and the deformation caused by the nip load is permanent. The gliding of the web surface against the roll surfaces may also give rise to alterations in fibre shape, thus enhancing the smoothing effect.

When multi-nip calendering has been used, the paper has usually been manufactured on a paper machine and thereafter coated, if desired. In both cases the coated or uncoated paper has been reeled onto storage rolls and calendered by means of separate calenders. The paper has been dried to a very low moisture content, typically about 1 to 3% of its total weight. Prior to calendering the paper is sufficiently wetted in order to obtain good calendering results. A suitable moisture content for multi-nip calendering is approximately 6 to 10%. The purpose of drying to a low moisture content is to achieve an even cross direction moisture content profile. The short storage time prior to the calendering step also evens out the moisture content profile. In present on-line calendering processes the web is dried to a high degree of dryness whereafter it is rewetted before calendering, and thus, the process is similar to off-line calendering.

The web can be wetted e.g. by means of the water jet damping device described in U.S. Pat. No. 5,286,348, which achieves an even moisture content profile in the cross-machine direction of the web.

The above-described method which comprises first drying and then rewetting the web is hampered by the time required by the absorption and evening out of the moisture, particularly in the thickness direction of the web and at the surface. If the wetting is performed immediately before calendering, the uneven moisture content profile will affect the final surface properties and the quality grade of the paper may be impaired.

Drying and rewetting increase the energy consumption during the manufacture of the product as well as the space required by the equipment when compared to a process which does dot require overdrying and rewetting prior to the calendering step. An uneven moisture content, e.g. surface moisture or an uneven moisture profile in some web direction leads to changes in the properties of the web, such as gloss or thickness profile because moisture has a strong impact on the workability of the fibres. In the case of an uneven thickness profile, problems will occur in winding, which may even cause cross-direction wrinkles in customer rolls because even tightness is not achieved. The wrinkles will reduce the runnability of the product in further processing e.g. during printing in other further processing machines, thus impairing the quality of the product from the customer's point of view.

Moisture profile affects many factors in the manufacture of paper or board as well as in the final quality of the product. One factor worth noticing is that if fluctuations occur in moisture content, drier parts of the web will start to shrink before the wetter parts, which in turn will lead to stretching of the wetter parts. Uneven stretching will then lead to uneven drying shrink, which in turn leads to thickness variations and variations also in other properties of the product.

In modern machines, the moisture content of the paper or board web to be manufactured is controlled in many ways particularly at the beginning of web formation. The most important target of controlling moisture content profile is good runnability of the machine and the product being manufactured, i.e. maximal production output within a given duration is striven for. This is understandable because moisture content profile and tension profile are highly interdependent. Thus, the best possible moisture content profile has been striven for in such parts of the machine where the effect of dampness profile control on runnability is at its greatest. The dampness profile of the finished base web is then not necessarily homogeneous and it is subject to tension. If the web is stored prior to calendering, the dampness will be evened out and the tensions will be relaxed, and thus, the evenness of the final dampness of the web is of less importance. If, however, on-line calendering is used, the homogeneity of the final dampness has a strong effect on product quality and if the web moisture content is controlled by present methods and principles, the properties of calendered paper or board may even suffer, and the desired improvement in the properties of the final product is not achieved. In multi-nip calenders, it is possible to exercise a relatively strong influence on the thickness profile of the web, but in these calenders a very high nip pressure is applied, wherefore the calendering will usually lead to a significant reduction in thickness and bulk when compared to other calender types. Thus, multi-nip calendering is normally used in the manufacture of products of which a high degree of smoothness and particularly gloss is expected.

One very important feature in the calendering process is that calendering is applied to obtain a slick and smooth surface without losing any more stiffness or bulk than is necessary. As the surface of paper or board is subjected to even very high pressure during calendering depending on calender type, the web is compressed, whereby its thickness is reduced and the web is compacted, in other words its mass per volume is increased, i.e. its bulk is reduced. A reduced thickness and bulk of the web will naturally also result in reduced stiffness. As maximal stiffness and light weight per volume unit is normally required of the product being manufactured, it is difficult to match the different effects of calendering with the properties of the end product.

On the other hand, calendering is used to standardize the thickness profile of the paper, i.e. to remedy thickness defects which may have occurred during web formation. The harder the surface of the rolls used, the easier it is to amend the profile, and thus a machine calender will usually obtain the best profile amendment results, and consequently, this is the most important field of use for this type of calenders. Today, a machine calender is used in many paper machines to finish the thickness profile and surface quality of paper such that they meet the requirements set for the final product. This has been so because there are only limited ways of controlling the cross-direction thickness profile on a paper or board machine, and an acceptable thickness profile cannot be achieved without machine calendering. By means of machine calendering it is possible to raise the surface quality of the product such that it meets end users' demands, but the properties of machine calenders are limited when it comes to improving surface quality, wherefore no remarkable improvement in smoothness or gloss can be obtained by means of a machine calender. As the quality requirements set for printing surfaces are constantly on the increase, other calendering methods must more and more often be used in addition to or instead of machine calendering.

Other types of calenders, such as soft-, long-nip or multi-nip calenders, will obtain a considerably improved surface quality, but they have a much weaker thickness profiling capability than machine calenders, mainly due to the softness of the surfaces on the parts which press the web. It is known that with a reduced tensile stiffness of the calender roll coating, the thickness profiling capability of the calender is impaired but its ability to produce a product with good printing properties is improved. As a machine calender has rolls of cast iron or steel, they may have very hard surfaces, resulting in good thickness standardization. On the other hand, the hard surface will exert stronger pressure on the web at its thicker and denser (harder) parts, wherefore the smoothing effect exerted on the web concerns the thicker parts of the web, and thus, surface properties will vary in different parts of the web.

SUMMARY OF THE INVENTION

The present invention aims at providing a method for manufacturing calendered paper or board, enabling the manufacture of a product having a uniform thickness profile, whereby the bulk of the web is reduced as little as possible, yet achieving good quality of the printing surface.

The invention is based on standardizing the cross-direction thickness profile of the base web prior to final calendering and performing the final calendering on a long-nip calender, for example a shoe calender.

In more detail, the method for producing a calendered product according to the present invention is characterized by standardizing the cross-directional thickness of the base web across a width of the base web to form a standardized web after forming the base web from a mixture of water and pulp supplied from a headbox and and calendering die standardized web at least once using a long-nip calender for modifying at least one side of the standardized web.

The arrangement according to the invention, then, is characterized by means for standardizing a cross-direction thickness of the base web across a width of the base web to form a standardized web after the base web is formed from a mixture of water and pulp fed from a headbox and a long-nip calender for modifying at least one side of the standardized web arranged downstream of the means for standardizing.

The invention allows considerable savings in the pulp of the base web, because the bulk of the web is better by as much as 5 to 10% after calendering than that of a product manufactured using conventional calendering methods. This is of considerable advantage for the paper or board manufacturer because the grammage of the product can be reduced without compromising its thickness and particularly its stiffness. Thus, it is possible for the manufacturer to have a smaller grammage and pulp consumption and to still produce paper or board having unaltered stiffness. The surface and printability properties of the product are good, as is its thickness profile. The good thickness profile results in good customer rolls of even tightness in the longitudinal direction of the roll, whereby wrinkle formation is reduced. Rolls of uniform tightness and precisely cylindrical shape are easy to handle at the plant and particularly during further processing, and the rolls have good runnability properties in further processing machines such as printing machines.

The product surface has homogeneous properties over the entire surface, and alterations in surface quality occurring due to machine calendering are avoided. The method according to the invention is well suited for raising the product quality of paper and board machines already in production e.g. in connection with modernizations. The invention is applicable to off-line calendering but is of particular advantage in on-line systems where the optimization of the manufacture of the base web is more easily combined with the optimization of the calendering event.

The present solution is applicable to the manufacture of both uncoated and coated products. In the manufacture of coated paper or board grades the coating step is carried out prior to the final calendering step, whereby a long-nip calender will obtain a very even and smooth surface and any unevenness of the base web will not show during visual inspection of the web, because the soft belt of a long-nip calender does not highlight unevenness as does e.g. the slightly harder roll coating of a softcalender.

In the following, the invention is examined in more detail with the help of a number of working examples and alternative embodiments.

Other objects and features of the invention will become apparent from the following detailed description.

In the following, the term long-nip calender is used to refer to a calender having a nip length of over 30 mm, typically 50 to 280 mm.

The purpose of calendering is to produce a good surface for paper or board of which a good printing surface is required. It is of importance in the manufacture of both paper and especially board that the stiffness of the product is reduced as little as possible. Often sufficient stiffness is of importance for the handling of the paper and in the case of printable packing boards, among others, the material must be of sufficient stiffness to enable the manufacture of strong packages. Previously known calendering methods provide reduced thickness and stiffness of the product, but the most modern long-nip calenders obtain good surface quality with only small losses in stiffness or bulk. In the case of a long-nip calender, a good surface is provided by means of a soft calendering surface, a relatively low surface pressure and a high thermoroll temperature. In a long-nip calender the calendering surface usually comprises a belt which is used to press the web against a heated thermoroll. A roll can be used for pressing the belt, whereby the length of the nip is limited, or a shoe can be used whereby considerable pressing distances are achieved. Another advantage of the shoe calender is that the length of the nip is adjustable as well as the cross-direction nip pressure distribution. The adjustment possibilities available are naturally dependent on the structure of the calender.

Another important purpose of a calendar is to amend the thickness profile of the product. As stated above, the thickness profile is better effected by a harder calendering surface. Thus, a long-nip calender allows much less acting on the thickness profile than other calenders because the hardness of the calendering belt or other means used is low when compared to the hardness of the rolls and roll coatings of other calender types. Thus, a long-nip calender does not allow any significant influence to be exerted on the thickness profile even when a zone-adjusted shoe calender is used.

On a paper or board machine the web is formed by feeding water and pulp from a headbox onto a wire or between two wires. The web having a high moisture content is dried by removing water by pressing the web over the press section and by heating it over the drying section by means of a drying cylinder, among others.

Today a number of devices are known which can be used to affect the thickness profile of the base web already during the formation step of the web, and consequently, web thickness can be standardized even before it enters the calender. Thus a long-nip calender may be used if the thickness profile of the web is standardized prior to calendering. The thickness profile of the base web can be affected in many ways during the formation and drying of the entire web. The first possibility to affect the web profile is in the headbox where the web is formed. In the headbox the fibre content of the pulp to be fed onto a former wire or into a twin wire can be adjusted e.g. by means of dilution adjustment by adding water into the pulp or, on the other hand, in the cross direction more pulp may be fed to certain parts of the wire where needed. In the press section of the machine, profiling steaming or compression may be applied, and in the drying section, profiling drying or wetting. Actuators affecting the profile include e.g. a dilution-adjusted headbox, a zone-adjusted press roll arranged in the press section or a belt-supported zone-adjusted press roll, a profiling steam box or wetter or a profiling web heater or cooler, e.g. a roll that is cooled zone by zone. Where a film transfer coater can be arranged prior to the calender, the profiling can be carried out by using the coater to apply water or an adhesive mixture onto the web surface. Instead of a film transfer coater, e.g. a spray coater can be used which has a simple construction and can be fitted even into a small space. The thickness profile of a web that has been dried to almost its final dryness can be further adjusted by profiling wetting or a hard calender nip. If e.g. a machine calender is used for standardizing the thickness profile of the web, it is of importance in the solution according to the invention that the nip load be kept small so as not to lose web thickness, bulk or stiffness during calendering. What is essential in the preferred embodiment of the invention is the optimization of the thickness profile adjustment of a paper or board machine for calendering.

The effect of the moisture content profile of the web and differences in moisture content has been discussed in the Applicants' parallel PCT Application No. FI98/00895, wherefore it may suffice in the present context to say that altering the moisture content profile of the web can be used to essentially affect the thickness profile. Said application is enclosed herein as reference.

According to the invention the thickness profile of the base web is standardized prior to calendering and the calendering step is carried out on a long-nip calender, preferably e.g. a shoe calender. As a shoe calender can no longer be used to essentially affect the thickness profile of the base web, the web must be of sufficiently homogeneous thickness already before calendering. The thickness profile can be standardized using the above-mentioned equipment. In order to be able to implement the method it must be ensured that the thickness of the base web has been standardized before the web enters the calender. For this reason, profile measurement is needed before the calender. Profile measurement can be carried out at any stage before calendering but as the thickness profile may be altered over the press section or during drying, there is cause to perform at least one measurement as close to the calender as possible, preferably immediately before calendering. Thickness profile measurement can be carried out prior to the last actuator which can be used to affect the thickness profile, whereby it is still possible to fix any possible profile defects by means of said actuator. The minimum requirement is that the profile be measured at least at one point prior to calendering and advantageously at least at one point prior to the last profiling instrument and immediately before the calender to ensure the fixing of any profile defect. After the calender a final quality assurance measurement can be carried out.

One advantageous way of standardizing the web thickness profile is to use a machine calender equipped with hard rolls which is run at a low nip pressure. In this case the nip pressure of the machine calender must be kept extremely low and the aim is not to use it to affect the microroughness of the surface. A machine calender can, however, be used to even at low nip pressures effectively even out the thickness profile, simultaneously smoothing out the macroroughness of the surface, i.e. variations in the shape of the surface that are clearly greater than the fibre thickness. The method is particularly well suited for the manufacture of coated grades of board or paper, whereby machine calendering is carried out prior to the first coating step and long-nip calendering after coating. In the following an example of such a method is described. The method is particularly well suited for the manufacture of liquid packaging board.

Conventionally, liquid packaging boards are coated twice because unbleached pulp is used for the core and bottom layers thereof, whereby a large amount of coating mix is required to obtain a surface of sufficient brightness. As coating method, blade coating is most commonly used, but even air brush coating is used because of its good opacity. Blade coating provides poor opacity and the air brush has poor runnability and limited speed. In addition, background wetting is required in order to control warp.

According to the invention the board is first calendered by means of a machine calender or a softcalender using low nip pressure which is usually below 50 MPa, the nip length being less than 50, typically 1 to 30 mm, and the surface temperature of the thermoroll being 80 to 300° C. When a softcalender is used, the coating has a hardness of 80 to 95 ShA. The purpose of precalendering is to alter the thickness profile and surface roughness of the board such that they are at the level required by the following treatment steps without significantly reducing the bulk and stiffness of the board. Due to this requirement the board is not calendered to have a fully smooth surface topography, instead, its Bendtsen roughness number may remain at a level below 700, typically 500 to 600 ml/min. The precalendering step can be enhanced by steaming or wetting with water.

After precalendering precoating is carried out preferably by means of a film transfer coater, whereby an opaque coat which well follows the surface contour is obtained. A film transfer coater can be used to simultaneously perform background wetting with water or a starch solution, wherefore separate background wetting is not required. The susceptibility to breaks of a film transfer coater is also considerably lower than that of blade coaters. The front coat is provided at a rod or blade coating head where jet application is used for applying the coating mix. The pressure impulse of a jet applicator is small wherefore the coat does not penetrate into the web but instead provides good opacity on the web surface. A long dwell distance is used between application and doctoring, whereby a set immobilization layer has time to form on the web surface whose dry matter content has risen. In this manner, a greater amount of coating mix and better opacity are achieved. A blade doctor achieves excellent smoothness of the end product, but a rod doctor may also be used.

The final calendering is carried out on a long-nip calender having a typical nip pressure of 1 to 12 MPa, a nip length of 30 to 280 mm and a thermoroll temperature of 100 to 300°0 C. The belt hardness of a long-nip calender is typically 80 to 100 ShA. The advantage provided by a long-nip calender lies in the excellent surface smoothness and glare achieved without reducing the stiffness and bulk of the product, as well as a visually very even surface. When a long-nip calender is used, any unevenness in the surface of the base web will not emerge during visual inspection due to the soft calendering belt and low nip pressure.

The method of the invention is especially suited for on-line arrangements but can also be used in off-line manufacturing systems where intermediate reeling is applied.

While there has been shown and described certain fundamental novel features of the present invention as applied to a preferred embodiment thereof, it will be understood by those skilled in the art that various omissions and substitutions and changes in the devices described herein, and in their operation, may be made by those skilled in the art without departing from the spirit and scope of the invention. It is expressly intended that all combinations of those elements and/or method steps that perform substantially the same function and substantially the same way to achieve the same results are within the scope of the invention. Substitutions of elements from one described embodiment to another are also fully intended and contemplated. It is the intention, therefore, to be limited only as indicated by the scope of the claims appended hereto.

What is claimed is:

1. A method for producing a calendered product, comprising the steps of:

(a) forming a base web from a mixture of water and pulp supplied from a headbox and drying the base web by pressing and heating;

(b) standardizing a cross-directional thickness of the base web across a width of the base web to form a standardized web, said standardizing comprising selectively steaming sections across the width of the base web during pressing; and (c) calendering the standardized web at least once using a long-nip calender for modifying at least one side of the standardized web.

2. The method of claim 1, wherein said step (b) of standardizing comprises selectively diluting the mixture of water and pulp supplied from the headbox in sections across the width of the base web.

3. The method of claim 1, wherein said step (b) of standardizing comprises selectively pressing sections of the base web across the width of the base web.

4. The method of claim 1, wherein said step (b) of standardizing further comprises selectively heating sections of the base web across the width of the base web.

5. The method of claim 1, wherein said step (b) of standardizing comprises selectively cooling sections of the base web across the width of the base web.

6. The method of claim 1, wherein said step (b) of standardizing comprises wetting sections of the base web across the width of the base web.

7. The method of claim 1, wherein said step (b) of standardizing further comprises selectively wetting sections of the base web with one of a film transfer coater and a spray coater across the width of the base web.

8. The method of claim 1, wherein said step (b) of standardizing comprises treating the base web with a machine calender prior to said step (c).

9. The method of claim 8, wherein said step of treating the base web with a machine calender comprises treating the base web with a zone-adjusted machine calender.

10. The method of claim 1, wherein said step (c) of calendering the standardized web comprises coating the standardized web with at least one coating layer and calendering the coated web with the long-nip calender.

11. The method of claim 10, wherein said step of calendering further comprises using a precalender having a nip length of less than 50 mm, a nip pressure that does not exceed 50 MPa, and a thermoroll temperature of 80 to 300° C., and wherein the long-nip calender has a nip length of 30 to 280 mm, a nip pressure of 1 to 12 MPa, a thermoroll temperature of 100 to 300° C., and a calender belt hardness of 80 to 100 ShA.

12. The method of claim 8, wherein said step (c) of calendering the standardized web comprises coating the standardized web with at least one coating layer and calendering the coated web with the long-nip calender.

13. method of claim 12, wherein said step of calendering further comprises using a precalender having a nip length of less than 50 mm, a nip pressure that does not exceed 50 MPa, and a thermoroll temperature of 80 to 300° C., and wherein the long-nip calender has a nip length of 30 to 280 mm, a nip pressure of 1 to 12 MPa, a thermoroll temperature of 100 to 300° C., and a calender belt hardness of 80 to 100 ShA.

14. The method of claim 1, wherein said step (c) of calendering the standardized web comprises coating the standardized web with at least one coating layer and calendering the coated web with the long-nip calender.

15. The method of claim 14, wherein said step of calendering further comprises using a precalender having a nip length of less than 50 mm, a nip pressure that does not exceed 50 MPa, and a thermoroll temperature of 80 to 300° C., and wherein the long-nip calender has a nip length of 30 to 280 mm, a nip pressure of 1 to 12 MPa, a thermoroll temperature of 100 to 300° C., and a calender belt hardness of 80 to 100 ShA.

16. The method of claim 1, further comprising the step of measuring a thickness profile of the base web at at least one point of the length of the base web prior to said step (c) of calendering.

17. The method of claim 16, wherein the thickness profile of the base web is measured with at least one actuator positioned upstream of the long-nip calender.

18. The method of claim 1, wherein said steps are performed continuously on-line in a paper or board machine.

19. The method of claim 1, further comprising the step of winding the standardized web onto a storage roll prior to said step (c) of calendering.

20. The method of claim 1, wherein said step (b) of standardizing further comprises at least one of: (i) selectively diluting the mixture of water and pulp supplied from the headbox in sections across a width of the base web, (ii) selectively pressing sections of the base web across the width of the base web, (iii) selectively drying sections of the base web across the width of the base web, (iv) selectively cooling sections of the base web across the width of the base web, (v) selectively wetting sections of the base web across the width of the base web, (vi) treating the base web with a machine calender, and (vii) treating the base web with a zone-adjusted machine calender for selectively applying pressure to sections across the width of the base web.

21. An apparatus for manufacturing a calendered paper or board comprising:

a headbox effective for forming a base web from a mixture of water and pulp fed from said headbox;

pressing means for removing water from the base web by pressing the base web;

drying means for drying the base web by heating the base web;

means for standardizing a cross-direction thickness of the base web across a width of the base web to form a standardized web, said standardizing means comprising means for selectively steaming sections across the width of the base web during pressing; and at least one calender comprising a long-nip calender for modifying at least one side of the standardized web.

22. The apparatus of claim 21, wherein said headbox comprises a dilution adjusted headbox.

23. The apparatus of claim 21, wherein said pressing means further comprises means for selectively steaming sections of the base web across the width of the base web.

24. The apparatus of claim 21, wherein said means for standardizing the cross-direction thickness of the base web is capable of selectively and adjustably pressing sections of the base web across the width of the base web.

25. The apparatus of claim 21, wherein said means for standardizing a cross-direction thickness of the base web comprises heating means for selectively heating sections of the base web across the width of the base web.

26. The apparatus of claim 21, wherein said means for standardizing a cross-direction thickness of the base web comprises cooling means for selectively cooling sections of the base web across the width of the base web.

27. The apparatus of claim 21, wherein said means for standardizing a cross-direction thickness of the base web comprises wetting means for selectively wetting sections of the base web across the width of the base web.

28. The apparatus of claim 27, wherein said wetting means comprises one of a film transfer coater and a spray coater arranged upstream of said long-nip calender.

29. The apparatus of claim 21, further comprising a machine calender for treating the base web upstream of a last of said at least one calendar.

30. The apparatus of claim 29, wherein the machine calender comprises a zone-adjusted machine calender for selectively applying pressure to sections across the width of the base web.

31. The apparatus of claim 21, further comprising a precalender and at least one coater for applying at least one coating layer onto the standardized web.

32. The apparatus of claim 31, wherein said precalender has a nip length of less than 50 mm, a nip pressure that does not exceed 50 MPa, and a thermoroll temperature of 80 to 300° C., and said long-nip calender has a nip length of 30 to 280 mm, a nip pressure of 1 to 12 MPa, a thermoroll temperature of 100 to 300° C., and a calender belt hardness of 80 to 100 ShA.

33. The apparatus of claim 29, further comprising a precalender and at least one coater for applying at least one coating layer onto the standardized web.

34. The apparatus of claim 33, wherein said precalender has a nip length of less than 50 mm, a nip pressure that does not exceed 50 MPa, and a thermoroll temperature of 80 to 300° C., and said long-nip calender has a nip length of 30 to 280 mm, a nip pressure of 1 to 12 MPa, a thermoroll temperature of 100 to 300° C., and a calender belt hardness of 80 to 100 ShA.

35. The apparatus of claim 21, further comprising a precalender and at least one coater for applying at least one coating layer onto the standardized web.

36. The apparatus of claim 35, wherein said precalender has a nip length of less than 50 mm, a nip pressure that does not exceed 50 MPa, and a thermoroll temperature of 80 to 300° C., and said long-nip calender has a nip length of 30 to 280 mm, a nip pressure of 1 to 12 MPa, a thermoroll temperature of 100 to 300° C., and a calender belt hardness of 80 to 100 ShA.

37. The apparatus of claim 21, further comprising means for measuring a thickness across the width of said base web at a point along the length of the base web upstream of the at least one calender.

38. The apparatus of claim 37, wherein said means for standardizing the cross-directional thickness includes at least one actuator, and said means for measuring is effective for measuring the thickness across the width of the base web at a point upstream of a last one of the at least one actuator.

39. The apparatus of claim 21, wherein said long-nip calender is an on-line calender in that the standardized web is received by said long-nip calender directly from the means for standardizing.

40. The apparatus of claim 21, further comprising a reeler for reeling up the standardized web onto a storage reel before the web is fed to said at least one calender.

41. The apparatus of claim 21, wherein said means for standardizing further comprises at least one of: (i) means for selectively diluting the mixture of water and pulp supplied from the headbox in sections across a width of the base web, (ii) means for selectively and adjustably pressing sections of the base web across the width of the base web, (iii) means for selectively drying sections of the base web across the width of the base web, (iv) means for selectively cooling sections of the base web across the width of the base web, (v) means for selectively wetting sections of the base web across the width of the base web, (vi) a machine calender, and (vii) a zone-adjusted machine calender for selectively applying pressure to sections across the width of the base web.

* * * * *